US005240445A

United States Patent [19]

Aoki et al.

[11] Patent Number: 5,240,445

[45] Date of Patent: Aug. 31, 1993

[54] POWER STEERING SYSTEM OF OUTBOARD MOTOR

[75] Inventors: Daisuke Aoki; Hidekazu Nagai, both of Shizuoka, Japan

[73] Assignee: Sukuki Jidosha Koygo Kabushiki Kaisha, Shizuoka, Japan

[21] Appl. No.: 866,276

[22] Filed: Apr. 13, 1992

Related U.S. Application Data

[63] Continuation of Ser. No. 524,937, May 18, 1990, abandoned.

[30] Foreign Application Priority Data

May 18, 1989 [JP] Japan ..... 1-122928
May 22, 1989 [JP] Japan ..... 1-126778
May 29, 1989 [JP] Japan ..... 1-132573

[51] Int. Cl.[5] ..... B63H 25/42

[52] U.S. Cl. ..... 440/58; 114/144 E; 440/53; 440/63; 180/79.1

[58] Field of Search ..... 114/144 R, 144 E; 440/53, 59, 60, 62, 58, 61, 63; 180/79.1

[56] References Cited

U.S. PATENT DOCUMENTS

| | | | |
|---|---|---|---|
| 3,739,738 | 6/1973 | Cavil | 180/79.1 |
| 4,004,537 | 1/1977 | Nilsson | 114/144 E |
| 4,041,889 | 8/1977 | Blanchard | 440/60 |
| 4,419,084 | 12/1983 | Borst | 440/63 |
| 4,593,780 | 6/1986 | Saito | 180/79.1 |
| 4,715,461 | 12/1987 | Shimizu | 180/79.1 |
| 4,865,145 | 9/1989 | Ijiri et al. | 180/79.1 |
| 4,869,334 | 9/1989 | Marumoto et al. | 180/79.1 |
| 4,934,473 | 6/1990 | Fushimi et al. | 180/79.1 |
| 4,940,102 | 7/1990 | Morishita | 180/79.1 |
| 4,959,787 | 9/1990 | Morishita et al. | 180/79.1 |

FOREIGN PATENT DOCUMENTS

| | | | |
|---|---|---|---|
| 63-112270 | 5/1988 | Japan | 180/79 |
| 64-90872 | 4/1989 | Japan | 180/79 |
| 1-145590 | 5/1989 | Japan | 440/60 |
| 314695 | 12/1989 | Japan | 440/60 |

*Primary Examiner*—Sherman Basinger
*Assistant Examiner*—Thomas J. Brahan
*Attorney, Agent, or Firm*—Finnegan, Henderson, Farabow, Garrett & Dunner

[57] ABSTRACT

A power steering system of an outboard motor to be mounted upon the body of a hull and including a steering bracket secured to the body of the hull, a swivel bracket rotatable about a body of the outboard motor and a pair of clamping brackets supporting the swivel bracket, comprises a manual steering unit for manually steering a steering element so as to operate the outboard motor, the manual steering unit including a link mechanism connected to the steering element and connected to the steering bracket, and a power unit operatively connected to the link mechanism of the manual steering unit. The power unit includes an electric motor for applying a steering assist force to the manual steering unit for reducing the steering load during steering operations through means of the link mechanism and also includes a mechanism for converting rotation of the electric motor into linear motion. The power steering system further comprises a clutch means operatively connected to the manual steering unit and the power unit and a control unit for controlling the connection of the power unit so as to be operatively disconnected from the manual steering unit. The power unit may be located upon an outside portion of the hull within a bracket or in front of the clamping bracket of the outboard motor.

8 Claims, 11 Drawing Sheets

POWER STEERING SYSTEM OF OUTBOARD MOTOR

This application is a continuation of application Ser. No. 07/524,937, filed May 18, 1990, now abandoned.

FIELD OF THE INVENTION

The present invention relates to a power steering system of an outboard motor, and more particularly to a power steering system of an outboard motor for reducing the steering load of the outboard motor including a power unit for applying a steering assist force to a manual steering system.

BACKGROUND OF THE INVENTION

A conventional manually operative steering system of an outboard motor exhibits a problem of increased steering load, which may result in difficulty of the steering operation, in accordance with wind and wave conditions, the speed of the hull, the navigation conditions of the hull, the trim angle of the outboard motor and like conditions.

In order to obviate the problems encountered with the conventional manual steering system, a hydraulic power steering system has also been proposed.

The proposed hydraulic power steering system is generally composed of the manual power steering system with which a power unit is associated. In such a hydraulic power steering system, the power unit is equipped with a hydraulic pump for generating a steering assist force.

However, the hydraulic power steering system of the prior art utilizes a power source of the outboard motor itself as the power source for driving a hydraulic pump. Accordingly, the hydraulic power steering system itself is complicated in structure and, moreover, in the case where it is required to apply the hydraulic power steering system to an existing outboard motor, the drive shaft within the drive shaft housing may be changed, such being troublesome and uneconomical.

OBJECTS OF THE INVENTION

An object of the present invention is to substantially eliminate the defects or drawbacks encountered within the prior art described above and to provide a power steering system of an outboard motor which is capable of maneuvering the steering system in the case of locking of a power unit of the system.

Another object of the present invention is to provide a power steering system of an outboard motor which is provided with a power unit which is mounted at a location effectively utilizing the space of the hull so as to be suitable for the amounting thereof upon a small sized boat.

SUMMARY OF THE INVENTION

These and other objects can be achieved according to the present invention by providing a power steering system of an outboard motor comprising a manual steering unit for manually steering a steering element of an outboard motor to be mounted upon the body of a hull and a power unit operatively connected to the manual steering unit and including an electric motor for applying a steering assist force to the manual steering unit for reducing the steering load during steering operations.

The power steering system may further comprise a clutch means operatively connected to the manual steering unit and the power unit, and a control unit for controlling the connection of the power unit so as to be engageable with or disengageable from the manual steering unit.

In accordance with another aspect of the present invention, there is provided a power steering system of an outboard motor to be mounted upon the body of a hull including a steering bracket secured to the body of the hull, a swivel bracket rotatable about a body of the outboard motor and a pair of clamping brackets supporting the swivel bracket, the power steering system comprising a manual steering unit for manually steering a steering element so as to operate the outboard motor, the manual steering unit including a link mechanism connected to the steering element and connected to the steering bracket, and a power unit operatively connected to the link mechanism of the manual steering unit and including an electric motor for applying a steering assist force to the manual steering unit for reducing the steering load during steering operations through means of the link mechanism, the power unit including means for converting rotation of the electric motor into linear motion. The power steering system may further comprise a clutch means operatively connected to the manual steering unit and the power unit and a control unit for controlling the connection of the power unit so as to be engageable with or disengageable from the manual steering unit.

In accordance with a further aspect of the present invention, there is provided a power steering system of an outboard motor to be mounted upon the body of a hull, and including a pair of clamping brackets for securing the outboard motor to the body of the hull, the power steering system comprising a manual steering unit for manually steering a steering element so as to operate the outboard motor, a power unit operatively connected to the manual steering unit and including an electric motor for applying a steering assist force to the manual steering unit for reducing the steering load thereof, and a bracket disposed upon the rear side of the body of the hull and adapted to accommodate the power unit, the clamping brackets being secured to the hull body through means of the bracket.

In accordance with a still further aspect of the present invention, there is provided a power steering system of an outboard motor to be mounted upon the body of a hull, and including a pair of clamping brackets for securing the outboard motor to the body of the hull, the power steering system comprising a manual steering unit for manually steering a steering element so as to operate the outboard motor and a power unit operatively connected to the manual steering unit and including an electric motor for applying a steering assist force to the manual steering unit for reducing the steering load thereof, the power unit being disposed upon a rear portion of the body of the hull and in front of the clamping brackets of the outboard motor.

According to the power steering systems of the types described above, in the case where the driving unit of the power steering system is accidentally locked, an abnormal current of the motor of the driving unit is detected by means of the control unit and the connection to the clutch associated with the driving unit is released. According to this clutch releasing action, the manual steering system is disconnected from the driving unit of the power steering system, whereby the outboard motor can be maneuvered manually by means of the manual steering unit. Accordingly, the reliability and the safety of the power steering system can be improved.

In accordance with another and further aspect of the power steering system of the types described above, the power unit can be located upon the outside of the rear portion of the hull, whereby the space of the rear portion of the hull can be utilized freely, so that the power steering system can even be mounted upon a small sized boat.

BRIEF DESCRIPTION OF THE DRAWINGS

For a better understanding of the present invention and to show how to operate the same, reference is now made, by way of preferred embodiments, to the accompanying drawings, in which like reference characters designate like or corresponding parts throughout the several views, and wherein.

DESCRIPTION OF THE PREFERRED EMBODIMENTS

In advance of the detailed description of preferred embodiments of the present invention, the conventional art will be described hereunder with reference to FIG. 11.

Figure 11:
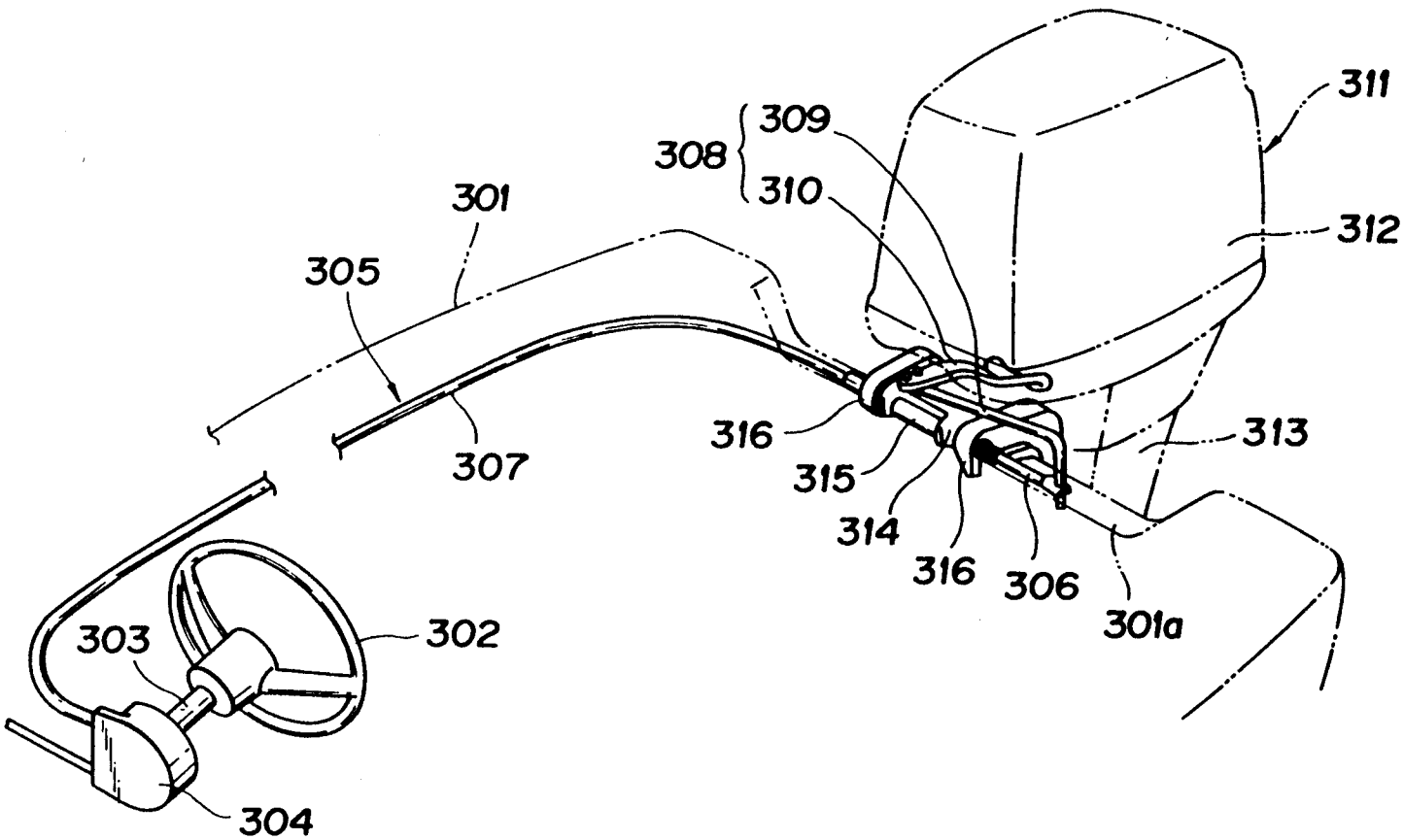
PRIOR ART FIG. 11
FIG. 11 is a brief perspective view showing a conventional manual steering system of an outboard motor mounted upon the body of a hull.

Referring to FIG. 11 showing a manual steering system of an outboard motor, when an operator operates a steering wheel 302 disposed at a driving station of a hull 301, a gear within a gear box 304 is rotated through means of a steering shaft 303. In response to the rotation of the gear, an inner cable 306 of a steering cable 305 is reciprocated axially forwardly or backwardly in a push-pull motion or mode. The steering cable 305 comprises an outer cable 307 and the inner cable 306 coaxially located therein.

The front end of the inner cable 306 extends slightly beyond the front end of the outer cable 307 and is connected to one end of a drag link 309 of a link mechanism 308. The drag link 309 has an L-shaped configuration and has its other end connected to one end of a pivotably reciprocable steering bracket 310. The other en of the steering bracket 310 is secured to a body 312 of an outboard motor 311.

The body 312 of the outboard motor 311 includes a drive shaft housing 313 including a drive shaft, not shown. The body 312 of the outboard motor 311 is supported by means of a swivel bracket 314 through means of a pilot shaft, not shown, secured to the outboard motor body 312 so as to be horizontally pivotable or steerable around the pilot shaft. The swivel bracket 314 is supported so as to be pivotable, that is, tiltable, in a vertical direction about a clamp bracket shaft 315 horizontally mounted within a pair of laterally spaced clamping brackets 316 and 316, by means of which a transom 301*a* of the hull 301 thereby secures the outboard motor body 312 to the hull 301. According to the structure described above, the body 312 of the outboard motor is horizontally bilaterally swung about the pilot shaft by means of the push-pull mode of operation of the inner cable 306 of the steering cable 305 through means of the link mechanism 308, whereby the hull body is able to be steered.

However, with respect to the manual steering system of the conventional type described above, the maneuvering of the outboard motor 311 may involve much labor by means of the operator as a result of an increase in the steering load applied to the motor 311 and boat during the steering operation due to the navigation conditions, such as, for example, the wind or wave conditions, hull speed, trim angle of the outboard motor 311, or the like.

In order to obviate the aforenoted defects of the conventional manual steering system and, hence, to reduce the steering load imposed thereon, conventional technology has developed hydraulic power steering systems for outboard motors. However, the hydraulic power steering systems of the prior art utilize the power source of the outboard motor itself as a power source for driving a hydraulic pump. Accordingly, the hydraulic power steering system itself is complicated in structure and, moreover, in a case where it is required to adapt the hydraulic power steering system to an existing outboard motor, the drive shaft within the drive shaft housing 313 must be changed, which is troublesome and uneconomical.

A power steering system according to the present invention conceived for substantially eliminating the defects or drawbacks encountered within the prior art described above will now be described hereunder with reference to FIGS. 1 to 10.

Basically, the embodiments of the present invention are equipped with an improved power unit in addition to the manual steering system of the type shown in FIG. 11.

Figure 1:
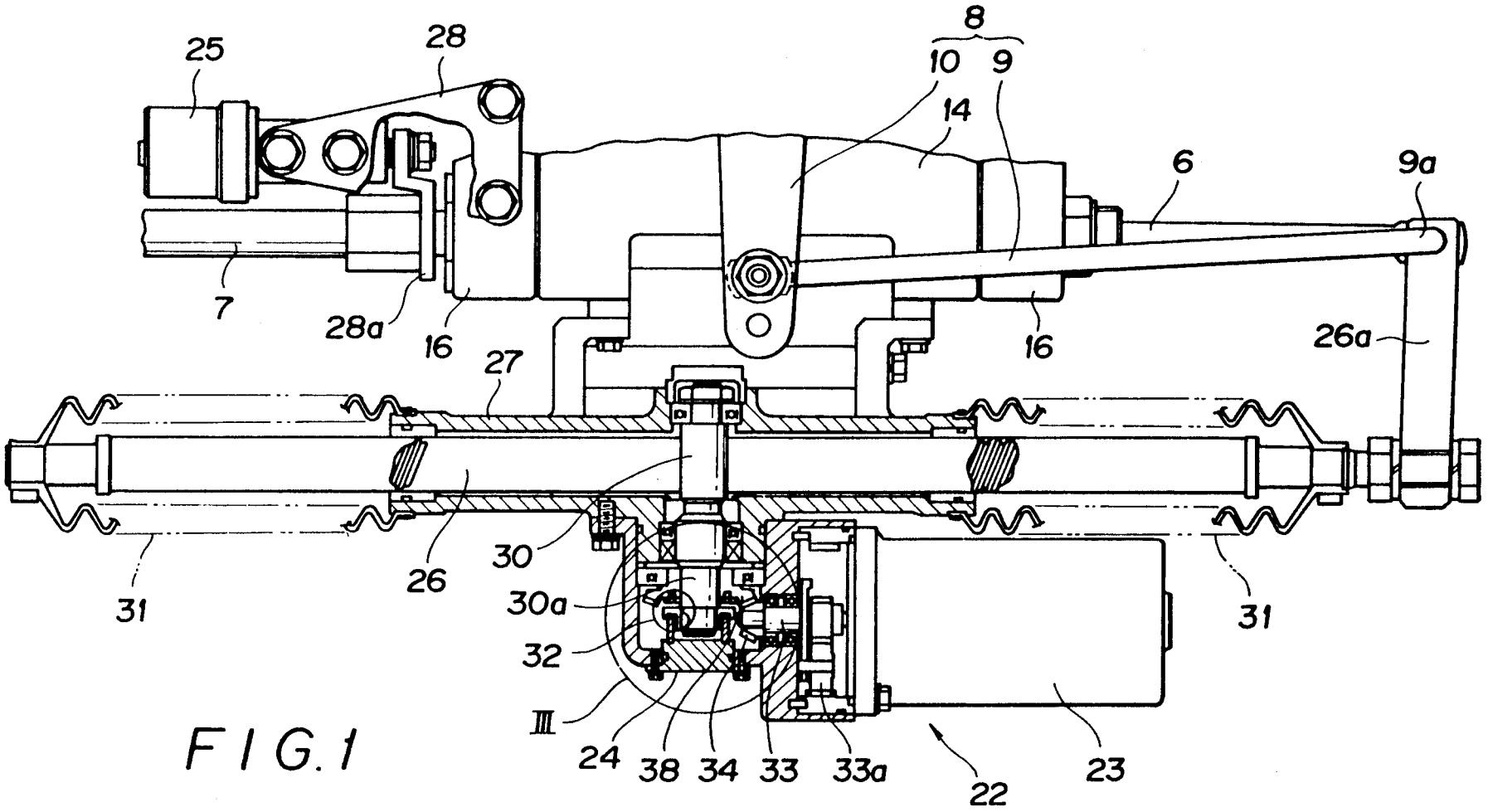
FIG. 1 is a plan view, partially broken and in section, of a power steering system according to the first embodiment of the present invention.
Figure 2:
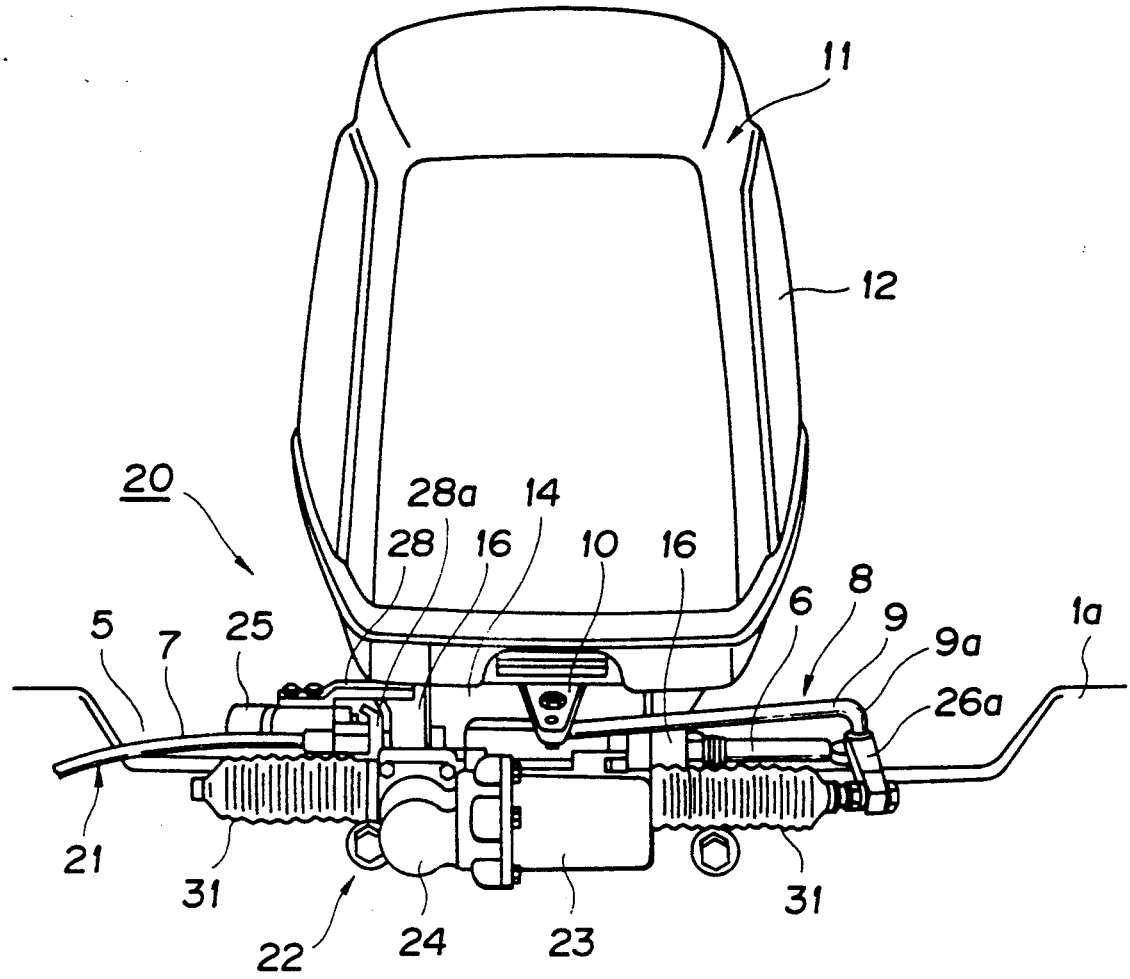
FIG. 2 is a front view of the outer appearance of the outboard motor provided with the power steering system of FIG. 1.

Referring to FIGS. 1 to 4 representing the first embodiment according to the present invention, FIG. 2 shows a front view of a power steering system 20 of the first embodiment of the present invention. Referring to FIG. 2, the power steering system 20 comprises a manual steering system 21 and a power unit 22 wherein the manual steering system 21 is of the type which is substantially the same as that shown in FIG. 11, so that the details thereof are now omitted herefrom.

The power unit 22 acts to apply a steering assist force directed in the same direction as the manual steering force of the manual steering system 21 to an input end of the link mechanism 308 (FIG. 11) so as to thereby reduce the steering load encountered by the operator. The power unit 22 comprises a motor box 23 in which a motor, not shown, is accommodated, a gear box 24 in which a reduction gear is accommodated and a sensor box 25 in which a torque sensor, not shown, is accommodated.

As shown in FIG. 1, the motor box 23 and the gear box 24 are integrally coupled with a rack 26 and a rack box 27, respectively, and the integral structure is secured to an upper portion of the swivel bracket 14 of the outboard motor 11 by means of bolts, for example.

The sensor box 25 is secured to a support arm 28 which, in turn, is secured to one of the paired clamping brackets 16 and a sensor rod, not shown, is slidably accommodated within the sensor box 25. The sensor rod has one end secured to a terminal end of an outer cable 7 which is similar to the outer cable 307 of the steering cable 305 shown in FIG. 11 by means of a stationary arm 28*a*. Within the sensor box 25 there is also accommodated a potentiometer.

When the inner cable 306 is pushed or pulled with respect to the outer cable 307 by means of the manual operation of the steering wheel 302, the reaction force applied to the outer cable 307 by means of the inner cable 306, that is, the steering load, is transmitted to the sensor rod through means of the stationary arm 28*a*. The displacement of the sensor rod is detected by means of the potentiometer disposed within the sensor box 25 and a signal representing the displacement detected by means of the potentiometer is transmitted to a controller 29 described later herein.

Figure 3:
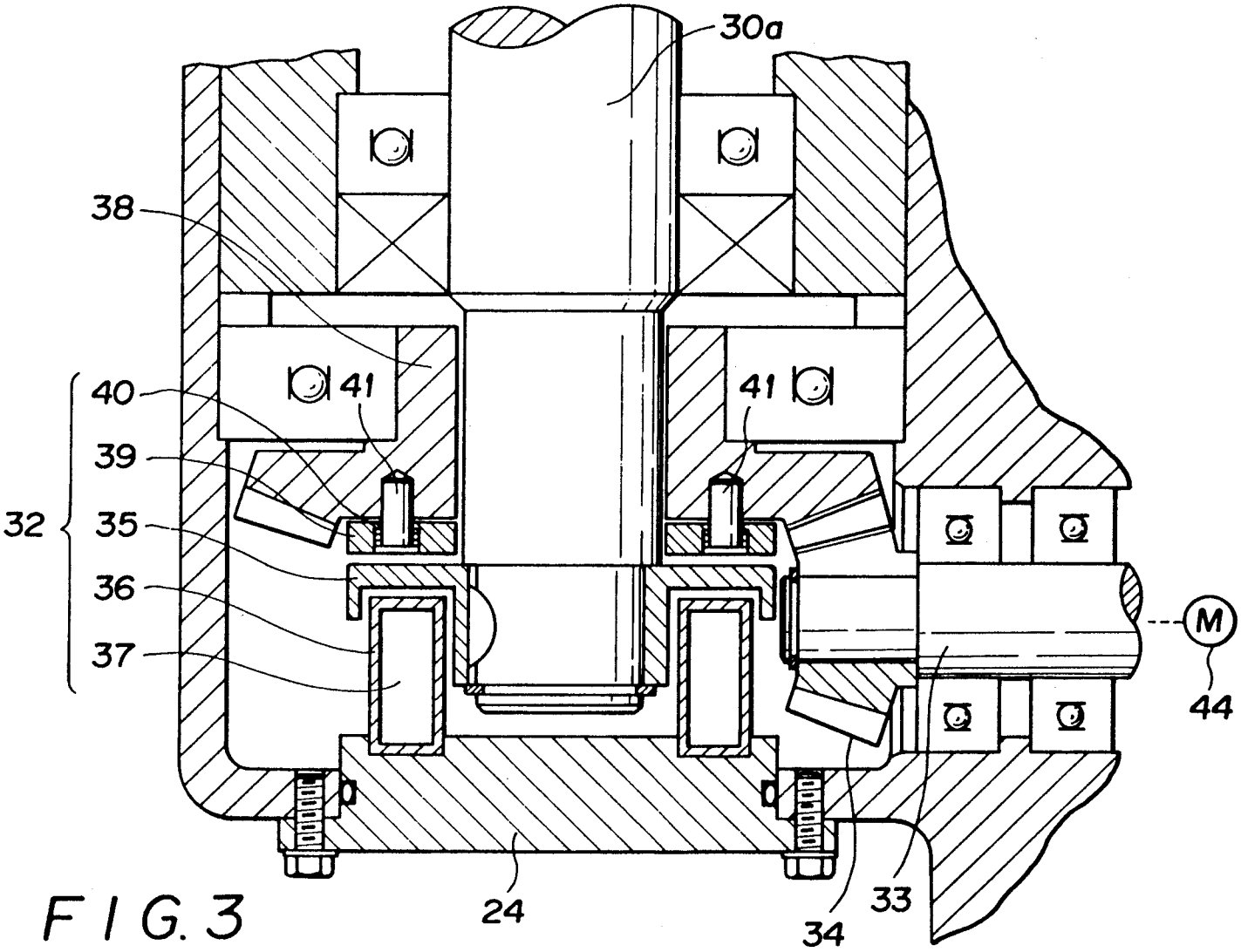
FIG. 3 is an enlarged view of the portion enclosed by means of the circle shown in FIG. 1.

The rack box 27 has axial ends to which expandable cylindrical bellows 31 and 31 are coaxially secured as shown in FIG. 2 and the rack 26 is accommodated within the rack box 27 in an axially reciprocating and liquid-tight or sealed manner. The rack 26 has one axial end (the right end as viewed in FIG. 1) secured to a bent end 9*a* of the drag link 9 through means of a stay 26*a* extending in a direction normal thereto and a pinion 30 is engaged with the rack 26 at an intermediate portion thereof. The pinion has a front end 30*a* extending into the gear box 24 and the projecting end 30*a* is selectively coupled with an output shaft 33 of a motor 44 through means of an electromagnetic clutch 32 as shown in FIG. 3. The output shaft 33 of the motor 44 is inserted into the gear box 24 with a star gear 33*a* of the reduction gear mounted upon an intermediate portion of the output shaft 33. A bevel gear 34 is mounted upon the inserted front end of the output shaft 33.

As shown in FIG. 3, a flat bottomed cylindrical rotor 35 is mounted coaxially upon the outer peripheral surface of the front end 30 of the pinion 30 extending into the gear box 24 with an open end of the rotor 35 disposed downwardly as viewed.

An annular member 36 for generating a magnetic field is arranged with a predetermined gap defined between or with respect to the inner bottom surface of the rotor 35 and the annular magnetic field generating member 36 is secured to the inner bottom surface of the gear box 24. An exciter coil 37 is disposed within the annular member 36 so as to always be in an excited state. An input bevel gear 38 is idly mounted around the outer periphery of the pinion front portion 30*a* so as to be disposed above the upper surface of the rotor 35 and the bevel gear 38 is disposed so as to always be engaged with the output bevel gear 34.

The input bevel gear 38 has an armature 39 secured to a central recessed portion of the bevel gear 38 by means of pins 41 and through means of a coil spring 40 so that the armature 39 moves towards the upper surface side of the rotor 35 so as to be substantially engaged or in contact therewith.

Accordingly, when the exciter coil 37 of the electromagnetic clutch 32 is excited or energized, the rotor 35 is magnetized through means of the magnetic field generated by means of the field generating member 36. As a result of this magnetic force, the rotor 35 attracts and tightly fixes the armature 39 against the spring force of the coil spring 40 of each of the pins 41. The rotor 35 is thus coupled with the input bevel gear 38 through means of the armature 39. Since the input bevel gear 38 is always rotated as a result of the engagement with the output bevel gear 34, the rotation of the output shaft 33 of the motor 44 is transmitted to the front end 30*a* of the pinion 30.

Figure 4:
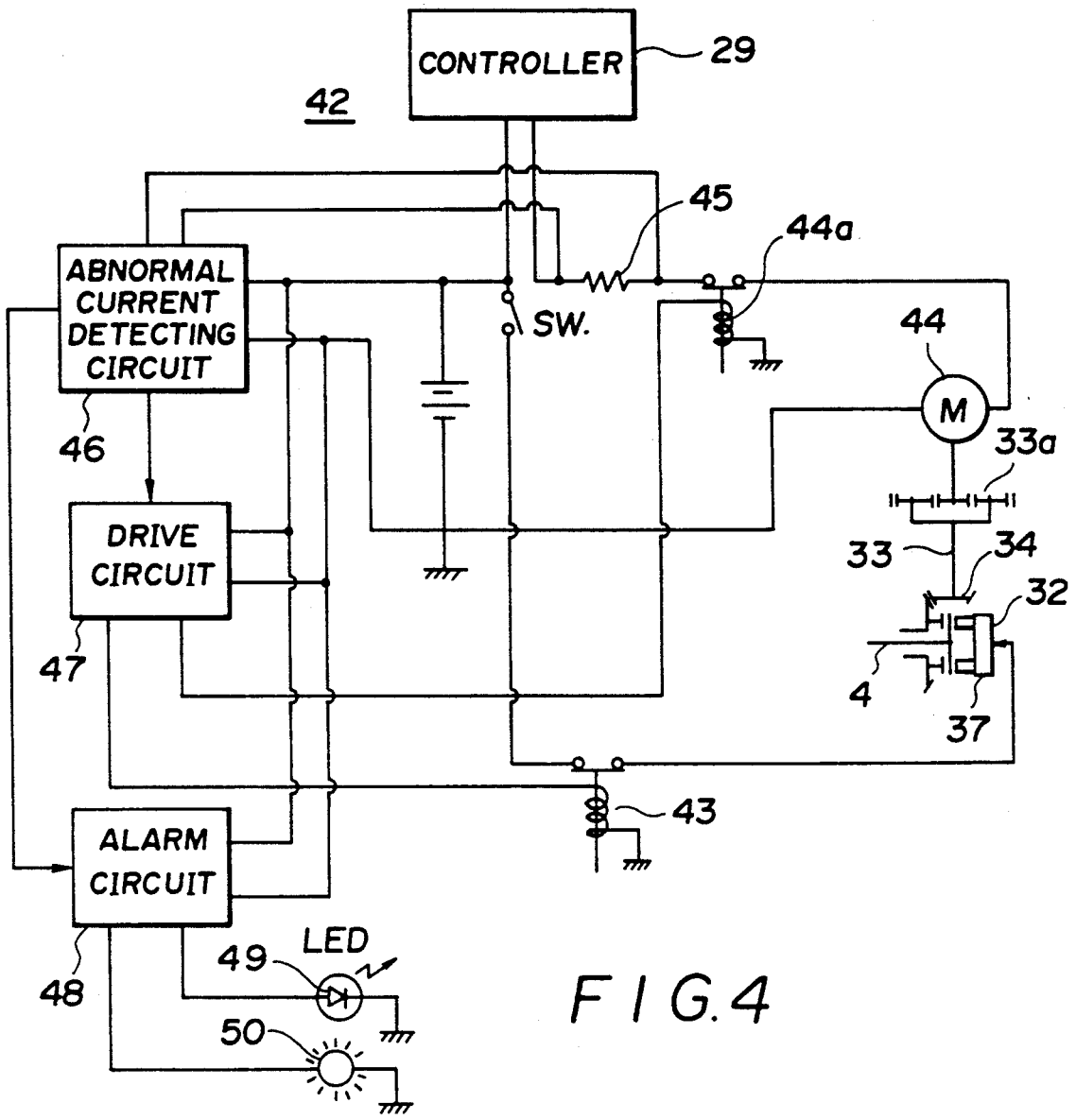
FIG. 4 is a brief circuit diagram of a control unit for the power steering system shown in FIG. 1.

The exciter coil 37 is electrically connected to the controller 29 of a control unit 42 through means of a relay 43 for cutting out or terminating the current passing to the electromagnetic clutch, as shown in FIG. 4.

The control unit 42 acts to detect an abnormal current passing to or through the motor 44 due to an overload condition by means of an abnormal current detecting circuit 46 through means of a shunt 45 at a time when the motor 44 or the driving unit therefor may be locked or jammed for any one of several different reasons or conditions.

When the abnormal current of the motor 44 is detected, an alarm circuit 48 is activated through means of a drive circuit 47, and the relay 43 for cutting out or terminating the electromagnetic clutch current and a relay 44*a* for cutting out or terminating the motor current are both opened.

When the alarm circuit 48 is activated, an alarm lamp 49 consisting of light emitting diodes (LED), for example, is illuminated and an alarm buzzer 50 is operated.

When the relay 43 is opened, the current conduction to the controller 29 and the electromagnetic clutch 32 is terminated so that the connection of the electromagnetic clutch 32 is released and the connection between the output shaft 33 of the motor 44 and the pinion front portion 30*a* is also released.

Accordingly, in the case where the motor 44 and the driving unit therefor of the power unit 22 is accidentally locked, the driving unit is released from the manual steering system 21 so that the steering system is freely operated manually.

The operation of the embodiment of the present invention of the construction described above will be described as follows.

In accordance with a normal operation of the power unit 22, the electromagnetic clutch 32 is energized, the input bevel gear 38 in engagement with the output bevel gear 34 of the output shaft 33 of the motor 44 is connected to the pinion front portion 30*a* and the driving system of the power unit 22 is coupled with the manual steering system 21. Accordingly, with reference to FIG. 11, when the steering wheel 302 is manually operated, the manual steering force is converted into the push or pull motion of the inner cable 306 of the steering cable 305, whereby the body 312 of the outboard motor 311 is swung horizontally bilaterally through means of the link mechanism 308. During this steering operation, the reaction force, that is, the steering load, impressed upon the outer cable 307 of the steering cable 305 is transmitted to the sensor rod within the sensor box 25 of the power unit 22.

The displacement of the sensor rod is detected by means of the potentiometer as a displacement signal and the detected signal is transmitted t the controller 29 of the control unit 42 in which the detected signal is converted into a predetermined motor operating signal, which is then transmitted to the motor 44 so as to drive the same.

The rotating power of the motor 44 is reduced by means of the star gear 33*a* and transmitted through means of the electromagnetic clutch 32 to the pinion 30, the rack 26 and the stay 26*a* in this order, and the rotating power is then transmitted to the link mechanism 9 as the steering assist force for reducing the steering load so as to thereby maneuver the body of the outboard motor.

However, when any abnormal condition is impressed upon the power unit by means of a particular condition or state of operation and the motor 44 or the star gear 33*a* of the reduction gear is locked, an overload is applied to the motor 44 and a large abnormal current passes. The abnormal current is detected by means of the abnormal current detecting circuit 46 so as to drive the driving circuit 47. The driving circuit 47 serves to change the contact of the relay 44*a* to the "OFF" state so as to terminate the conduction of the current to the motor 44 and also serves to change the contact of the relay 43 to the "OFF" state so as to terminate the current conduction to the electromagnetic clutch 32, whereby the alarm lamp 49 is illuminated and the alarm buzzer 50 is operated.

Accordingly, upon the stopping of the rotation of the motor 44, the power unit 22 is disconnected from the manual steering system 21 by releasing the connection of the electromagnetic clutch 32, whereby the generation of the abnormal condition is indicated by means of the alarm components 49 and 50 and an operator can operate the steering system manually by means of the manual steering system 21 which is now free from the power unit 22, thus improving the reliability and security of the power steering system.

Figure 5:
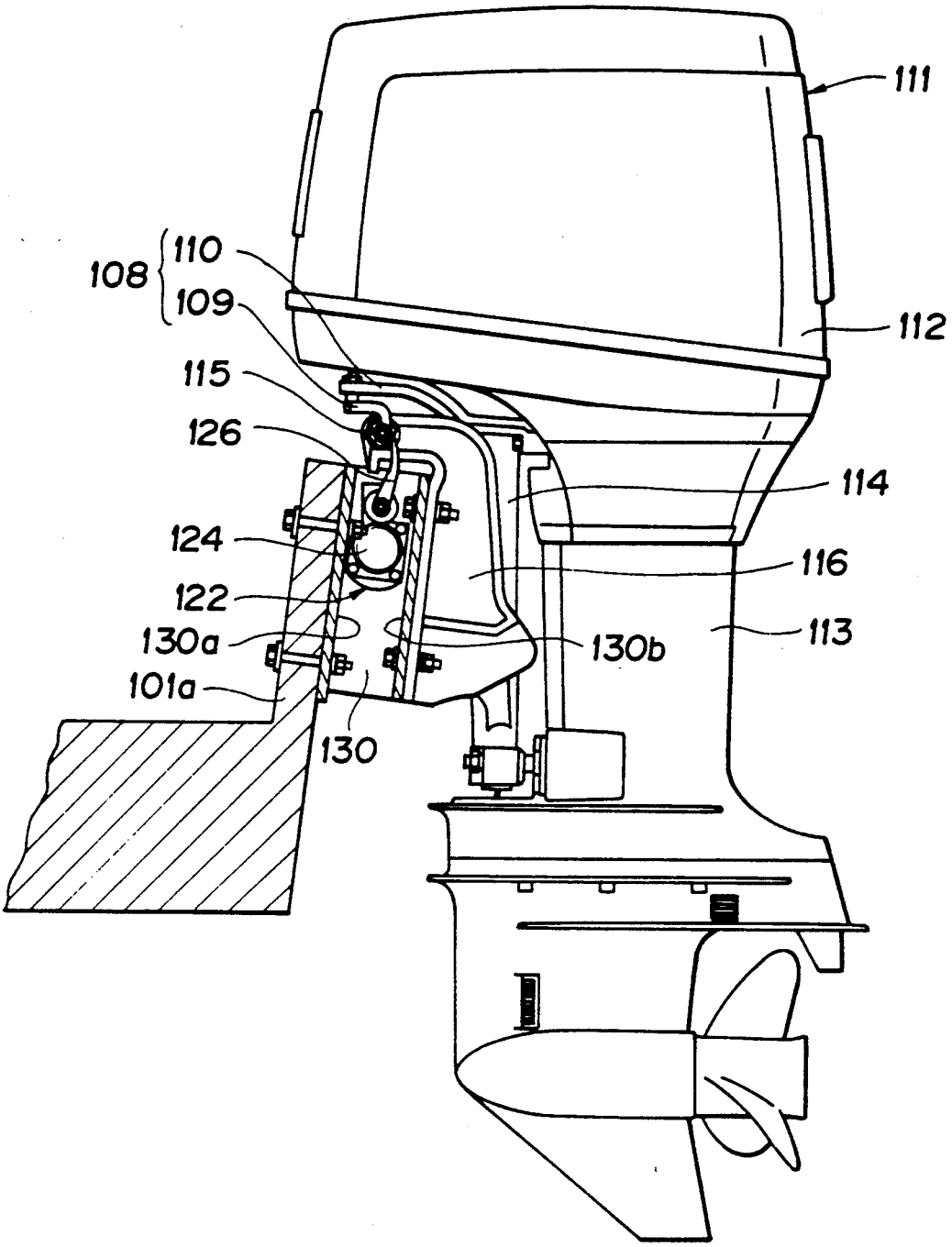
FIG. 5 is a side view of a power steering system of an outboard board according to the second embodiment of the present invention.
Figure 6:
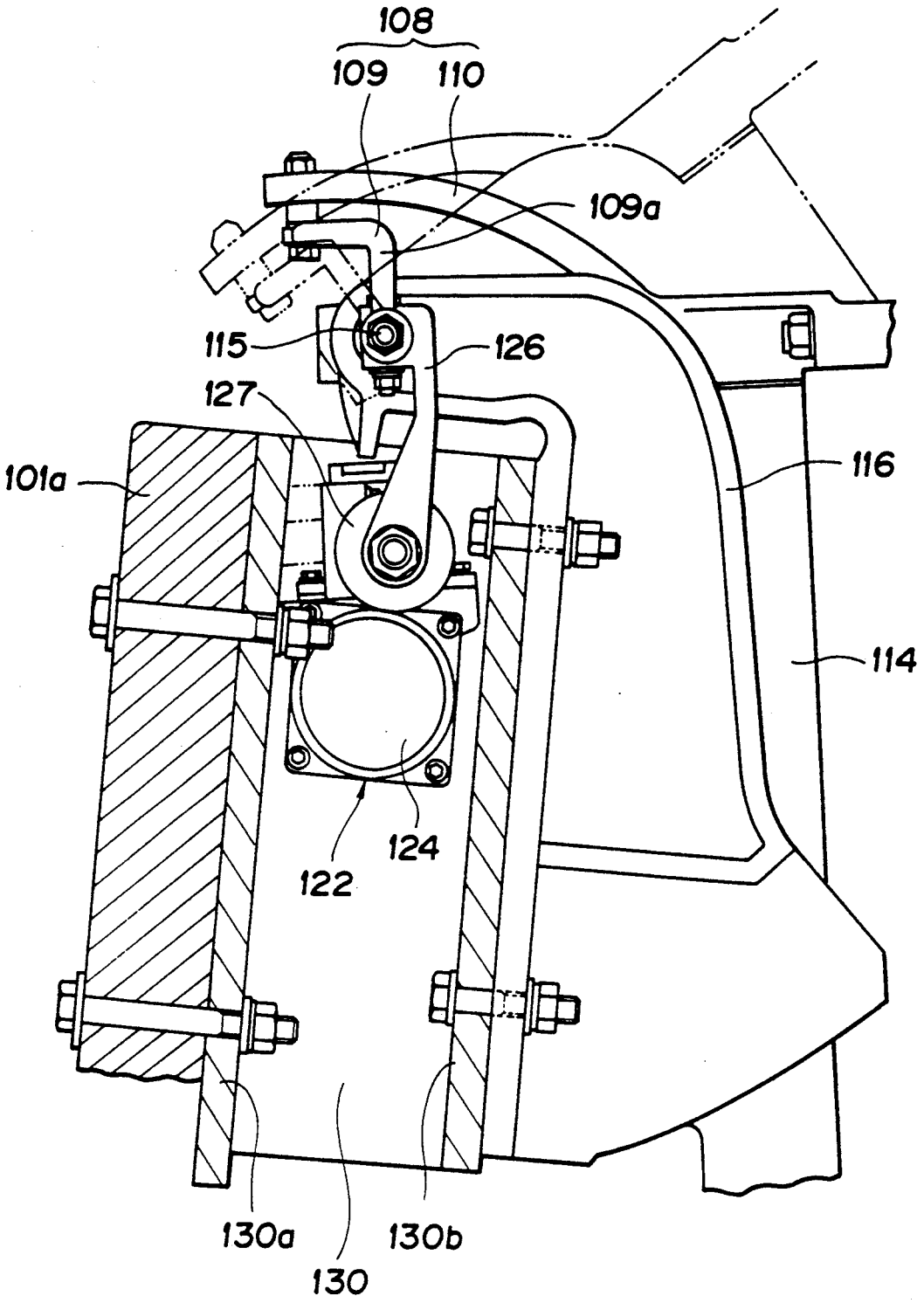
FIG. 6 is an enlarged side view particularly showing the location of the power unit of FIG. 5.
Figure 7:
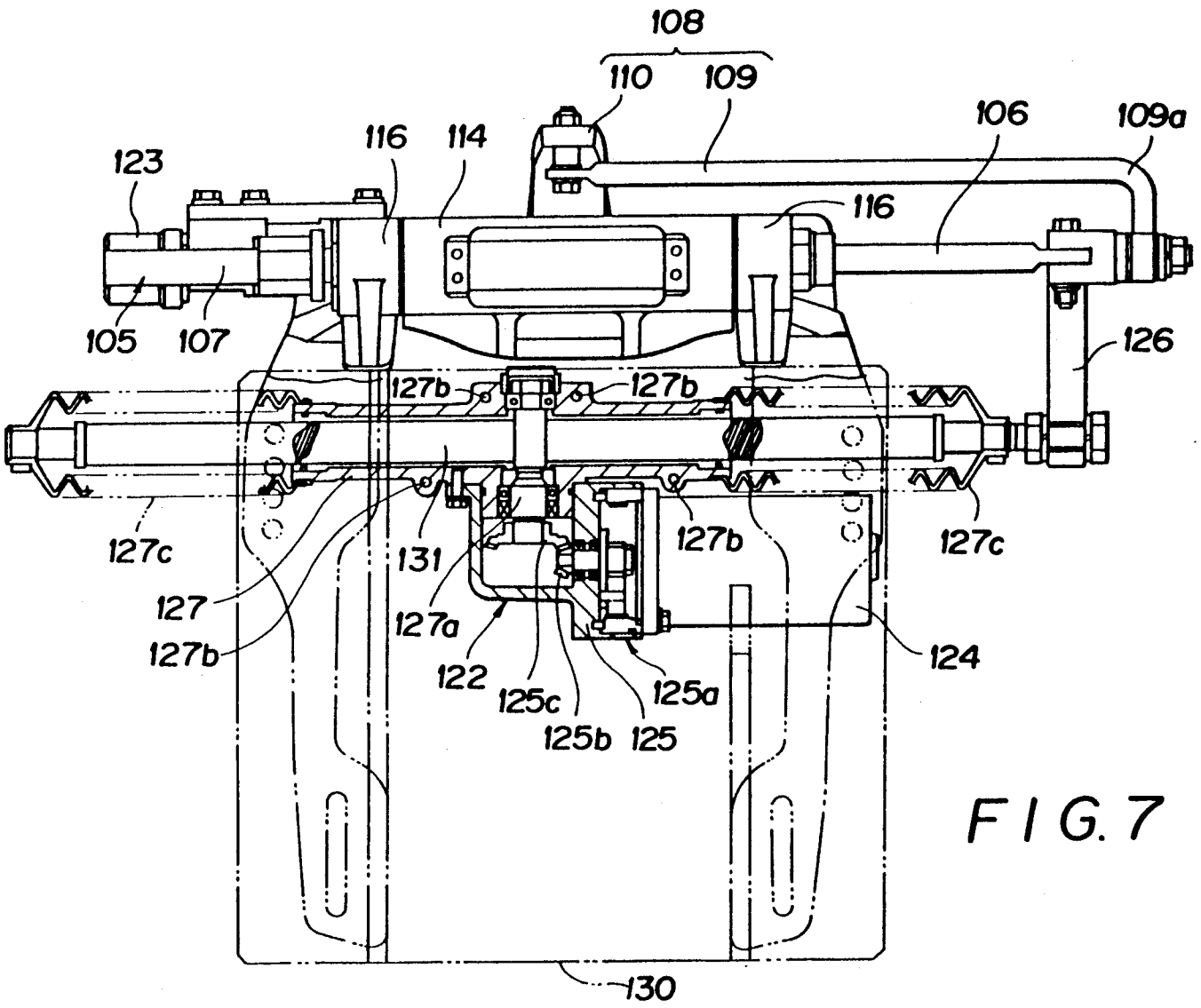
FIG. 7 is a front view, partially in section, of the power steering system shown in FIG. 5 before assembly with the outboard motor.

FIGS. 5 to 7 represent a second embodiment of the present invention which comprises an improvement with respect to the first embodiment described above for effectively utilizing the space of the hull.

In accordance with this embodiment, a power unit 122 of the type similar to that shown within FIG. 2 is accommodated in a bracket 130 and an outboard motor is mounted upon the outer side surface of a transom 101*a* of a hull through means of the bracket 130.

Referring to FIG. 7, the rotation of the power unit motor is transmitted to a pinion 127*a* and a rack 131 through means of a star gear 125*a* serving as a reduction gear accommodated in a gear box 125 and input and output bevel gears 125*c* and 125*b* so as to thereby axially reciprocate the rack 131.

The reciprocating motion of the rack 131 is transmitted to a drag link 109 of a link mechanism 108 through means of a stay 126 so as to swing and steer the body 112 of the outboard motor 111 horizontally and bilaterally. Since the reciprocating motion of the rack 131 is in substantially the same direction of the push-pull motion of the inner cable 306 (FIG. 11) of the manual steering system, the steering load of the steering wheel is reduced, thus rendering the maneuverability thereof quite easy.

The power unit 122 is disposed entirely below a swivel shaft 115 and one end of the stay 126 is secured by means of bolts to the bent end 109*a* of the L-shaped drag link 109 together with the front end of the inner cable 306.

The other end of the stay 126 extends further downwardly and is secured to one outer end of the rack 131 so as to extend in a direction normal thereto. The outer end of the rack 131 is a portion penetrating axially into the rack box 127 and extending slightly outwardly therefrom. The pinion 127*a* is engaged with the rack 131 at an axial intermediate portion thereof and the axial front end of the pinion 127*a* extends into the gear box 125.

The gear box 125 is secured to the lower portion of the rack box 127 and is provided with one side surface (the right side surface as viewed in FIG. 7) to which one end of the motor box 124 is secured.

Substantially the entire structure of the power unit 122 having the construction described above is accommodated within the bracket 130 which has a parallelepiped configuration with the side surface thereof being substantially square as seen in FIG. 7. A bilateral pair of bellows 127*c* and 127*c* are coaxially secured to the axial bilateral ends of the rack box 127 and both outer ends of the bellows extend slightly outwardly beyond the outer surface of the bracket 130 so as to be expandable. The stay 126 is disposed entirely outward of the bracket 130.

The bracket 130 is provided with a front board 130*a* which is secured by bolt means, for example, to the outer side surface of the transom 101*a* of the hull and is also provided with a rear board 130*b* which is secured by bolt means, for example, to the inner surface of a clamping bracket 116.

According to this embodiment, the power unit 122 is accommodated within the bracket 130 and is secured to the outside (that is, the rear side) surface of the transom 101*a* of the hull, so that the power unit 122 does not protrude inwardly into the hull when the outboard motor 111 is tilted upwardly as shown in FIG. 6 with dotted lines about the swivel shaft 115, thus effectively utilizing the inner space of the hull and, hence, the outboard motor of this embodiment can be mounted upon a small sized motor boat.

Figure 8:
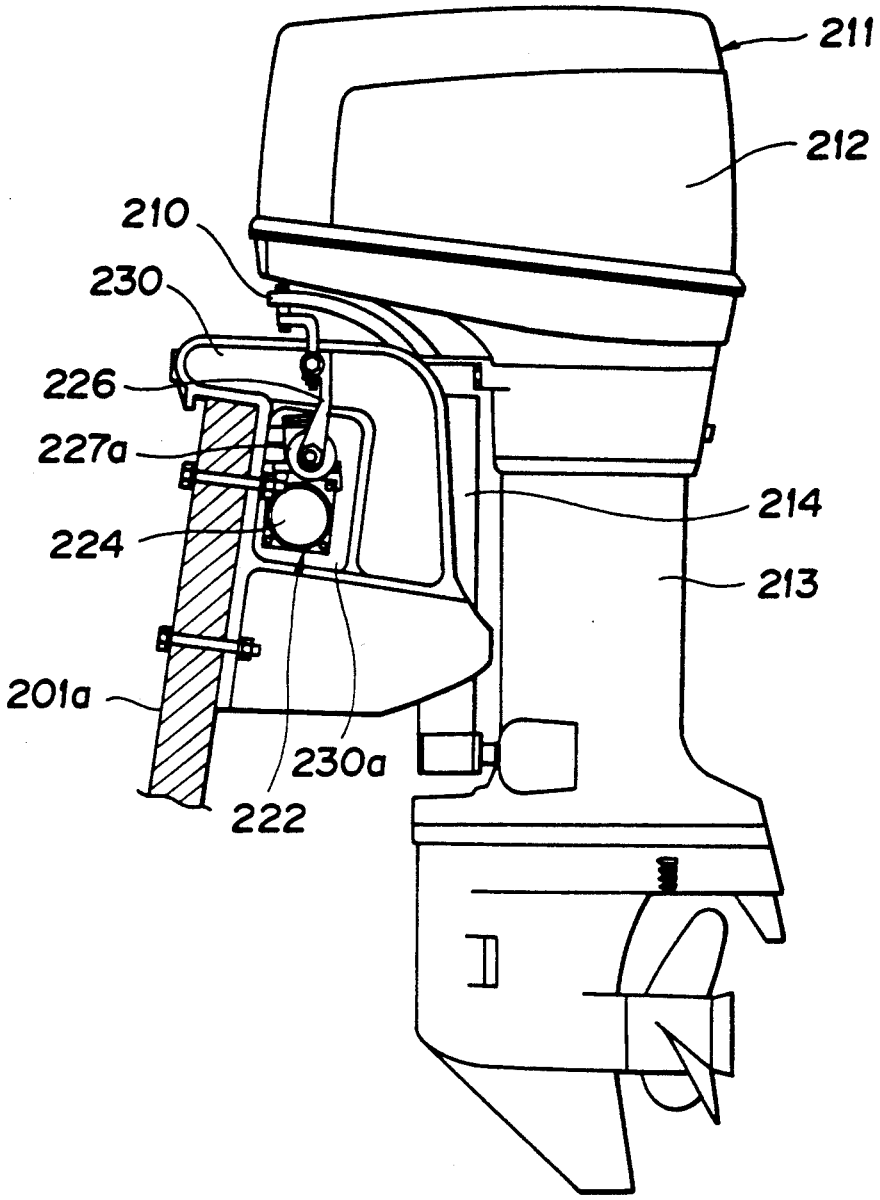
FIGS. 8, 9 and 10 are views similar to those shown in FIGS. 5, 6 and 7, respectively, according to the power steering system of the third embodiment of the present invention.
Figure 9:
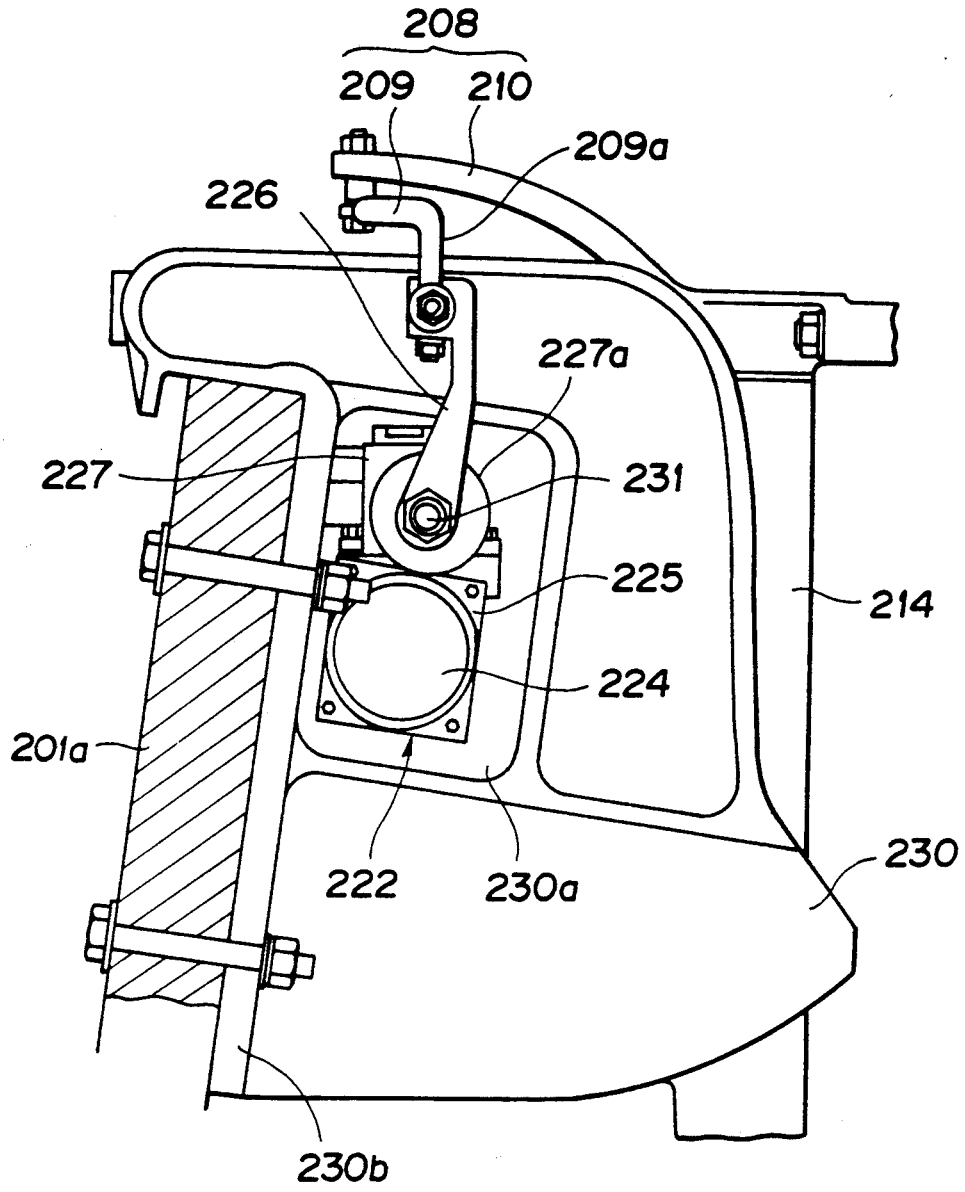
Figure 10:
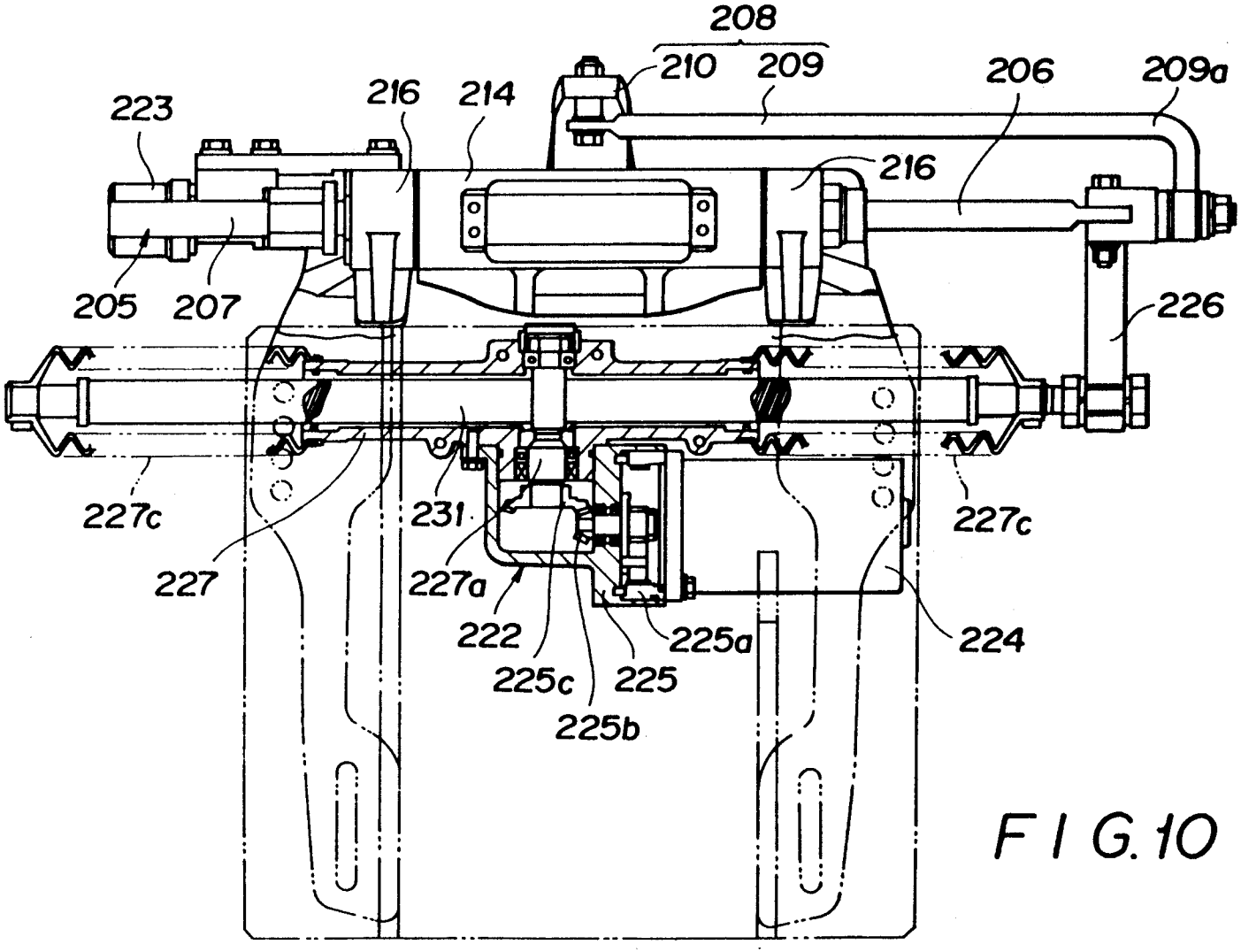

FIGS. 8 to 10 represent the third embodiment constructed according to the present invention in which a rack box 227, a gear box 225 and a motor box 224 of a power unit 222 are vertically arranged as shown in FIG. 8 and the power unit 222 is disposed in front of a pair of laterally spaced clamping brackets 230 and 230 located outside (that is, to the rear of) the transom 201*a*. The remaining structure of the outboard motor of the third embodiment is substantially the same as that described with reference to the second embodiment and referring to the FIGS. 8 to 10, to elements and members corresponding to those shown in FIGS. 5 to 7 are designated by means of reference numerals which have been developed by adding 100 to the numerals of the embodiment of FIGS. 5–7, for example, outboard motor 111 to 211 and the details thereof are omitted herefrom.

Referring to FIGS. 8 and 9, the power unit 222 constituted vertically is arranged horizontally so as to be bridged between through holes 230*a* and 230*a* of the clamping brackets 230 and 230. The through holes 230*a* and 230*a* have, for example a rectangular shape, and are defined within front portions of the clamping brackets 230 and 230 so as to be positioned near the outside surface of the transom 201*a*. Both axial ends of the power unit 222 penetrate the through holes 230*a* and 230*a*, respectively. Both outer ends of a laterally spaced pair of expandable bellows 227*c* and 227*c* coaxially secured to the axially spaced ends of the rack box 227 extend slightly outwardly beyond the outer ends of the through holes 230*a* and 230*a*. The stay 226 is disposed entirely outwardly of the right through hole 230*a* as seen in FIG. 10.

Each of the brackets 230 is provided with a front board 230b which is secured by bolt means, for example, to the outside surface of the transom 201a of the hull.

According to the third embodiment of the present invention of the construction described above, the power unit 222 is bridged between the through holes 230a and 230a of the clamping brackets 230 and 230 and is mounted upon the outside surface of the transom 210a of the hull, so that the power unit 222 does not protrude inwardly of the hull when the outboard motor 212 is tilted upwardly about the swivel shaft 215, thus effectively utilizing the inner space of the hull and, hence, the outboard motor of this embodiment can be mounted upon a small sized motor boat.

It will be easily understood by persons skilled in the art that the power units 122 and 222 of the second and third embodiments may be provided with the electromagnetic clutch means and the control units therefor referred to with respect to the first embodiment without utilizing any additional specific techniques.

Obviously, many modifications and variations of the present invention are possible in light of the above teachings. It is therefore to be understood that within the scope of the appended claims, the present invention may be practiced otherwise than as specifically described herein.

What is claimed is:

1. A power steering system of an outboard motor, comprising:

a manual steering unit, for manually steering a steering element so as to operate an outboard motor, mounted upon a body of a hull;

a power unit operatively connected to said manual steering unit and including an electric motor for applying a steering assist force to said manual steering unit for reducing steering load during steering operations;

electromagnetic clutch means operatively interconnecting said electric motor of said power unit with said manual steering unit;

means for detecting an abnormal electric current passing through said electric motor and for terminating electric power to said electromagnetic clutch means upon detection of said abnormal electric current so as to disconnect said power unit from said manual steering unit;

rack and pinion means, including a rack and a pinion, interposed between said electromagnetic clutch means and said manual steering unit for transmitting said steering assist force from said power unit, through said electromagnetic clutch means, to said manual steering unit;

a first bevel gear rotatably mounted upon a rotary output shaft of said electric motor; and a second bevel gear disposed about said pinion and engaged with said first bevel gear so as to be rotated by said first bevel gear, said electromagnetic clutch means comprising an armature mounted upon said second bevel gear, a rotor fixedly mounted upon said pinion, and an exciter means for electromagnetically energizing said rotor so as to attract said armature into engagement with said rotor, whereby said pinion is able to be rotated through means of said rotor, said armature, said second bevel gear and said first bevel gear.

2. A power steering system as set forth in claim 1, further comprising:

relay means interposed between said means for detecting said abnormal electric current and said exciter means for interrupting said electric power to said exciter means upon detection of said abnormal electric current.

3. A power steering system as set forth in claim 2, further comprising:

second relay means interposed between said means for detecting said abnormal electric current and said electric motor for interrupting said electric power to said electric motor upon detection of said abnormal electric current.

4. A power steering system of an outboard motor to be mounted upon a body of a hull and including a steering bracket secured to said body of said hull, a swivel bracket rotatable about a body of said outboard motor, and a pair of clamp brackets supporting said swivel bracket, comprising:

a manual steering unit, for manually steering a steering element so as to operate said outboard motor, said manual steering unit including a link mechanism connected to said steering element and to said steering bracket;

a power unit operatively connected to said link mechanism of said manual steering unit and including an electric motor for applying a steering assist force to said manual steering unit, for reducing steering load during steering operations, through said link mechanism;

electromagnetic clutch means operatively interconnecting said electric motor of said power unit with said manual steering unit;

rack and pinion means, including a rack and a pinion, interposed between said electromagnetic clutch means and said manual steering unit for transmitting said steering assist force, by converting rotation of said electric motor of said power unit into linear motion, from said power unit, through said electromagnetic clutch means, to said manual steering unit;

means for detecting an abnormal electric current passing through said electric motor and for terminating electric power to said electromagnetic clutch means upon detection of said abnormal electric current so as to disconnect said power unit from said manual steering unit;

a first bevel gear rotatably mounted upon a rotary output shaft of said electric motor; and a second bevel gear disposed about said pinion and engaged with said first bevel gear so as to be rotated by said first bevel gear, said electromagnetic clutch means comprising an armature mounted upon said second bevel gear, a rotor fixedly mounted upon said pinion, and an exciter means for electromagnetically energizing said rotor so as to attract said armature into engagement with said rotor, whereby said pinion is able to be rotated through means of said rotor, said armature, said second bevel gear and said first bevel gear.

5. A power steering system as set forth in claim 4, wherein:

said steering bracket is secured upon said body of said hull so as to be movable within a horizontal plane and about a vertical axis; and said swivel bracket is mounted upon said clamp brackets so as to be pivotable within a vertical plane about a horizontally disposed axis.

6. A power steering system as set forth in claim 4, wherein:

said electromagnetic clutch means, said electric motor, and said rack and pinion means are mounted upon an external surface of said body of said hull so as to maximize space within said body of said hull.

7. A power steering system of an outboard motor to be mounted upon a body of a hull and including a pair of clamp brackets for securing said outboard motor to said body of said hull, comprising:

a manual steering unit for manually steering a steering element so as to operate said outboard motor;

a power unit operatively connected to said manual steering unit and including an electric motor for applying a steering assist force to said manual steering unit for reducing steering load during steering operations;

bracket means disposed upon a rear side of said body of said hull for accommodating said power unit, said clamp brackets being secured to said hull body through said bracket means;

electromagnetic clutch means operatively interconnecting said electric motor of said power unit with said manual steering unit;

rack and pinion means, including a rack and a pinion, interposed between said electromagnetic clutch means and said manual steering unit for transmitting said steering assist force from said power unit, through said electromagnetic clutch means, to said manual steering unit;

means for detecting an abnormal electric current passing through said electric motor and for terminating electric power to said electromagnetic clutch means upon detection of said abnormal electric current so as to disconnect said power unit from said manual steering unit;

a first bevel gear rotatably mounted upon a rotary output shaft of said electric motor; and a second bevel gear disposed about said pinion and engaged with said first bevel gear so as to be rotated by said first bevel gear, said electromagnetic clutch means comprising an armature mounted upon said second bevel gear, a rotor fixedly mounted upon said pinion, and an exciter means for electromagnetically energizing said rotor so as to attract said armature into engagement with said rotor, whereby said pinion is able to be rotated through means of said rotor, said armature, said second bevel gear and said first bevel gear.

8. A power steering system of an outboard motor to be mounted upon a body of a hull and including a pair of clamp brackets for securing said outboard motor to said body of said hull, comprising:

a manual steering unit for manually steering a steering element so as to operate said outboard motor;

a power unit operatively connected to said manual steering unit and including an electric motor for applying a steering assist force to said manual steering unit for reducing steering load during steering operations, said power unit being disposed upon a rear portion of said body of said hull and in front of said clamp brackets of said outboard motor;

electromagnetic clutch means operatively interconnecting said electric motor of said power unit with said manual steering unit;

rack and pinion means, including a rack and a pinion interposed between said electromagnetic clutch means and said manual steering unit for transmitting said steering assist force from said power unit, through said electromagnetic clutch means, to said manual steering unit;

means for detecting an abnormal electric current passing through said electric motor and for terminating electric power to said electromagnetic clutch means upon detection of said abnormal electric current so as to disconnect said power unit from said manual steering unit;

a first bevel gear rotatably mounted upon a rotary output shaft of said electric motor; and a second bevel gear disposed about said pinion and engaged with said first bevel gear so as to be rotated by said first bevel gear, said electromagnetic clutch means comprising an armature mounted upon said second bevel gear, a rotor fixedly mounted upon said pinion, and an exciter means for electromagnetically energizing said rotor so as to attract said armature into engagement with said rotor, whereby said pinion is able to be rotated through means of said rotor, said armature, said second bevel gear and said first bevel gear.

* * * * *